US005794920A

United States Patent [19]

Kronberger

[11] Patent Number: 5,794,920

[45] Date of Patent: Aug. 18, 1998

[54] HYDRAULIC WINCH ASSEMBLY USING A VEHICLE STEERING PUMP

[76] Inventor: Gale A. Kronberger, 3026 Little Shield, Cheyenne, Wyo. 82009

[21] Appl. No.: 967,450

[22] Filed: Nov. 11, 1997

Related U.S. Application Data

[63] Continuation of Ser. No. 600,334, Feb. 13, 1996, abandoned, which is a continuation-in-part of Ser. No. 300,361, Sep. 1, 1994, abandoned.

[51] Int. Cl.[6] ..... B66D 1/08

[52] U.S. Cl. ..... 254/361; 254/323; 254/377; 60/420

[58] Field of Search ..... 254/328, 323, 254/361, 377; 60/484, 420

[56] References Cited

U.S. PATENT DOCUMENTS

| | | | |
|---|---|---|---|
| 2,349,284 | 5/1944 | Kinzelman | 254/361 |
| 3,035,414 | 5/1962 | Smith | 254/361 X |
| 3,261,590 | 7/1966 | Bech et al. | 254/377 X |
| 3,788,605 | 1/1974 | Johnson | 254/361 |
| 3,817,033 | 6/1974 | Appel et al. | 254/361 X |
| 4,331,323 | 5/1982 | Sekimori et al. | 254/323 |
| 4,658,850 | 4/1987 | Uchino | 60/422 X |
| 5,474,278 | 12/1995 | Cleveland | 254/361 X |
| 5,522,582 | 6/1996 | Dilks | 254/323 |

*Primary Examiner*—Donald P. Walsh
*Assistant Examiner*—Emmanuel M. Marcelo
*Attorney, Agent, or Firm*—David L. Volk

[57] ABSTRACT

A hydraulic motor is configured to drive a cable spool. A first fluid diverting valve is hydraulically connected between a discharge of a vehicle steering pump and the hydraulic motor. The first fluid diverting valve is configured to divert full fluid flow to a vehicle power steering box, and to divert full fluid flow to the hydraulic motor. A second fluid diverting valve is hydraulically connected between the first fluid diverting valve and an inlet of the vehicle steering pump. The second fluid diverting valve is configured to divert full fluid flow from the first fluid diverting valve to the hydraulic motor and to divert full fluid flow from the first fluid diverting valve to the inlet of the vehicle steering pump, bypassing the hydraulic motor and permitting fluid flow between the inlet of the hydraulic motor and the outlet of the hydraulic motor through the second fluid diverting valve so that manual operation of the winch is permitted. A shutoff valve is hydraulically connected between the second fluid diverting valve and the hydraulic motor to stop fluid flow through the hydraulic motor, thereby providing braking of the hydraulic motor.

7 Claims, 5 Drawing Sheets

HYDRAULIC WINCH ASSEMBLY USING A VEHICLE STEERING PUMP

RELATED APPLICATIONS

This application is a continuation of application Ser. No. 08/600,334, filed Feb. 13, 1986, now abandoned, which is a continuation-in-part of application Ser. No. 08/300,361, filed Sep. 1, 1994, now abandoned.

BACKGROUND OF THE INVENTION

1. Field of Invention

This invention relates generally to vehicle mounted winches, and more particularly, to a hydraulic winch utilizing a vehicle steering pump as a source of pressurized hydraulic fluid.

2. Description of Prior Art

It is well known that hydraulic winches provide a more efficient and lower maintenance alternative to electric winches. Remote-location winch operation is achieved without the inherent reliability problems, limited run time or added size and weight attributable to large electrical power supplies and signal conditioners. Heavy load handling and extended run time operation are provided by a smaller, more efficient and more reliable hydraulic motor.

Typically, hydraulic winch design efforts have been directed at providing a system with specialized functional attributes for specific, primarily commercial applications. For example, Bell, U.S. Pat. No. 5,176,364, discloses a multi-spool assembly driven by a diesel engine. Gravenhurst, U.S. Pat. No. 4,950,125 discloses a crane-mounted winch with disc brakes for better free-fall braking. Hrescak, U.S. Pat. No. 4,227,680, discloses a hydraulic winch utilizing a multiple belt drive configuration for a faster spool rewinding. Peterson, U.S. Pat. No. 4,650,163, discloses a specially designed tractor mount assembly for easier installation. Johnson, U.S. Pat. No. 3,788,605, discloses a spool-enclosed motor and companion bumper mount for more compact passenger car mounting.

Most pertinent to the present invention is Johnson which, while claiming the enclosed motor and mounting configuration, also preliminarily discloses powering the winch with a vehicle hydraulic steering pump. As Johnson notes, the steering pump is, of course, already available. But more importantly, the pump is an ideal source of pressurized fluid for both light and heavy winch operation, utilizing only about one half quart of fluid to provide a low, 2 to 4 gallons per minute fluid volume at a high, 1000 to 1400 p.s.i. of pressure. It also provides a requisite fluid reservoir and pressure relief valve. Johnson further fails to account for such critical considerations as reliable steering system and winch operation, modern vehicle construction, efficiency and, most importantly, operator safety.

First, Johnson provides no means for directing hydraulic fluid for safe and efficient operation of either the steering system or the winch. System-specific containment is critical given the small available volume of fluid. Escaping fluid can cause back-pressure on inactive system startup or even inconsistent or insufficient fluid supply. The consequences include sluggish response or even sudden catastrophic failure, both with potentially disastrous results.

Also, Johnson does not anticipate a means for cooling the hydraulic fluid. Since the hydraulic fluid lubricates internal gears, bearings and other components, fluid overheating and subsequent fluid breakdown could again have disastrous results. The alternative of adding a backup reservoir would complicate and enlarge the assembly.

Additionally, the disclosed control means do not provide for efficient, reliable and safe winch operation. Efficiency is compromised due to the lack of free-spooling capability; for example, motorized reeling out of 100 feet of cable at typically 5 feet per minute requires 20 minutes as opposed to only about one minute of manual reeling. The cabin-mounted lever and wire connection is incapable of providing sufficient "push" to rotate conventional winch mounted controls. The suggested alternative, manual control, places the operator in an unsafe position proximate to the cable spool during winch operation.

In addition, the reel-enclosed motor and necessitated companion components are structurally unsound and operationally ineffective. A singular, shaft-end motor support limits towing capacity and renders the design subject to catastrophic failure at this one stress point. The capstan drive mechanism necessitated by the configuration further limits towing capacity. The reel size must either be increased, such that torque is compromised, or decreased, such that motor size (and therefore towing capacity) is compromised. Even ignoring these structural deficiencies, the proposed bumper mount fails to take into account the insufficient mooring provided by conventional low-impact bumpers.

Thus there is a need for a hydraulic winch for automobiles, particularly utility vehicles, that utilizes the power steering pump, properly directs hydraulic fluid alternatively for steering and winch operations, provides an integral fluid cooling means and provides for complete and safe operation.

SUMMARY OF THE INVENTION

The present invention is specifically intended to provide a self-maintaining, full featured, vehicle mounted winch, with easy installation and reliable and safe use; including continuous heavy load use. The hydraulic winch assembly utilizes a conventional hydraulic motor, spindle and mount. It further provides a steering-biased hydraulic fluid directing means, a vehicle steering box interface, a fluid cooling means and a remote control means. Mounting is preferably limited to reinforced bumpers, chassis or other stable moorings.

An object of the invention is to provide a system for utilizing an existing power steering pump to alternatively provide pressurized hydraulic fluid to a conventional hydraulic motor.

Another object of the invention is to provide such a system in which hydraulic fluid naturally flows to the power steering system and electrical power is applied to operate a switching mechanism for diverting the fluid to the hydraulic winch system. Vehicle steering is thus left unaffected for normal vehicle operation.

Yet another object of the invention is to provide such a system offering complete winch operation, such as forward, reverse, free spooling and braking.

And another object of the invention is to provide a simple and reliable means for cooling the hydraulic fluid such that fluid breakdown due to heat and resultant loss of lubricating qualities is preempted. Extended continuous operation and heavy load reeling are therefore non-destructive to the power steering pump, steering system or winch.

Further, it is an object of the invention to provide such a system that is fully remote controllable and therefore safely separates the operator from the motor and cable spool.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENT

1. Detailed Description of the Figures

Figure 1:
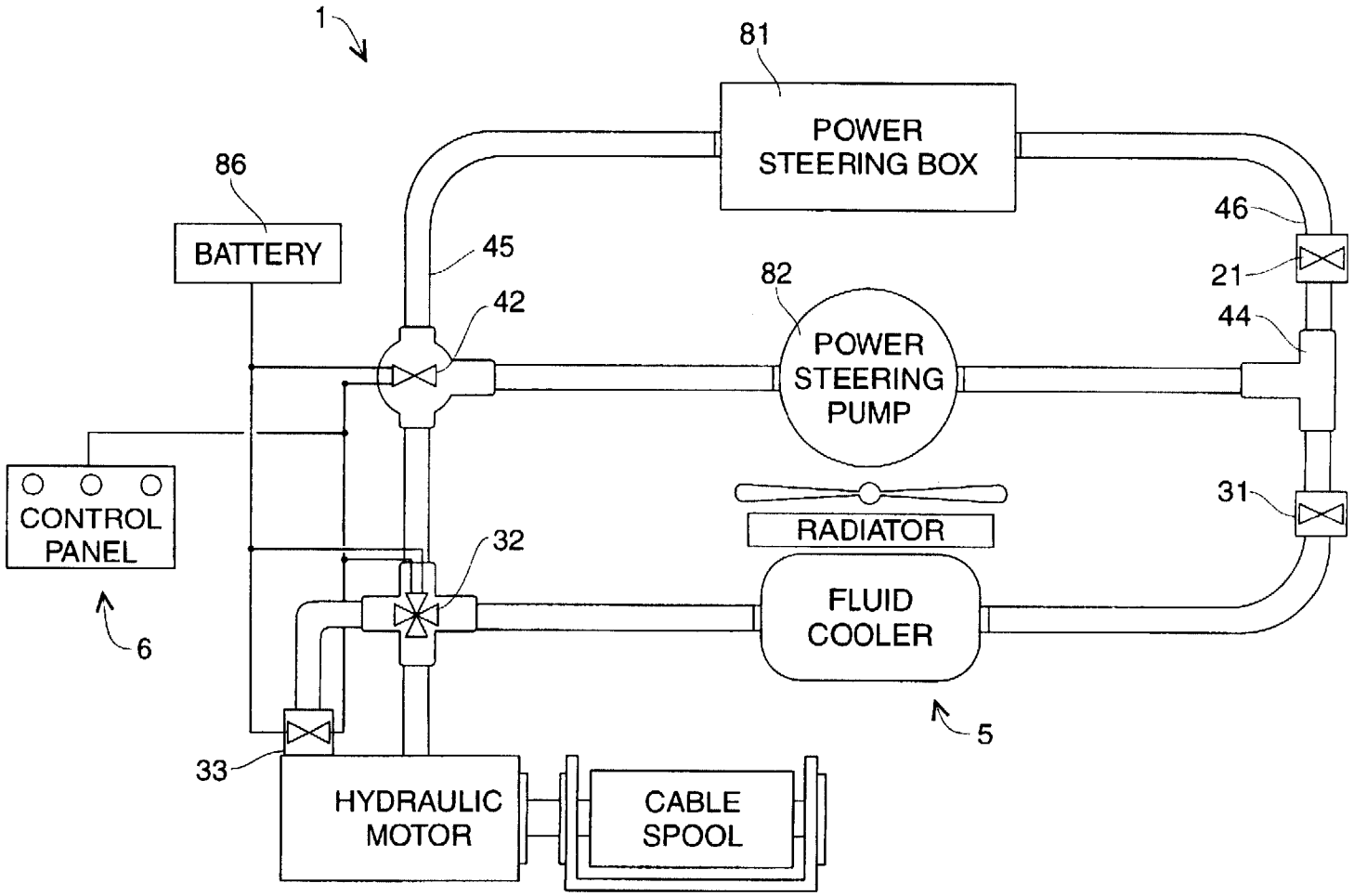
FIG. 1 is a schematic diagram depicting a hydraulic winch assembly according to the preferred embodiment of the present invention.

FIG. 1 shows that the preferred hydraulic winch assembly (winch assembly) 1 provides a fluid flow system, fluid cooling means and a control system for utilization of an existing vehicle hydraulic power steering pump 82 while assuring both efficient, reliable and independent steering system and winch operation. The fluid flow system comprises a conventional steering check valve 21 and winch check valve 31, a first and second electrically switchable multi-port diverter valves 32 and 42 respectively, a shutoff valve 33, tubing 45 and 46, interconnected with conventional fittings as will be described below. An in-line fluid cooler 5 cools hydraulic fluid during winch operation. A control system comprises a cabin-mounted control panel 6, an existing vehicle battery 86, and conventional wiring to the valves 32, 33 and 42.

Figure 2:
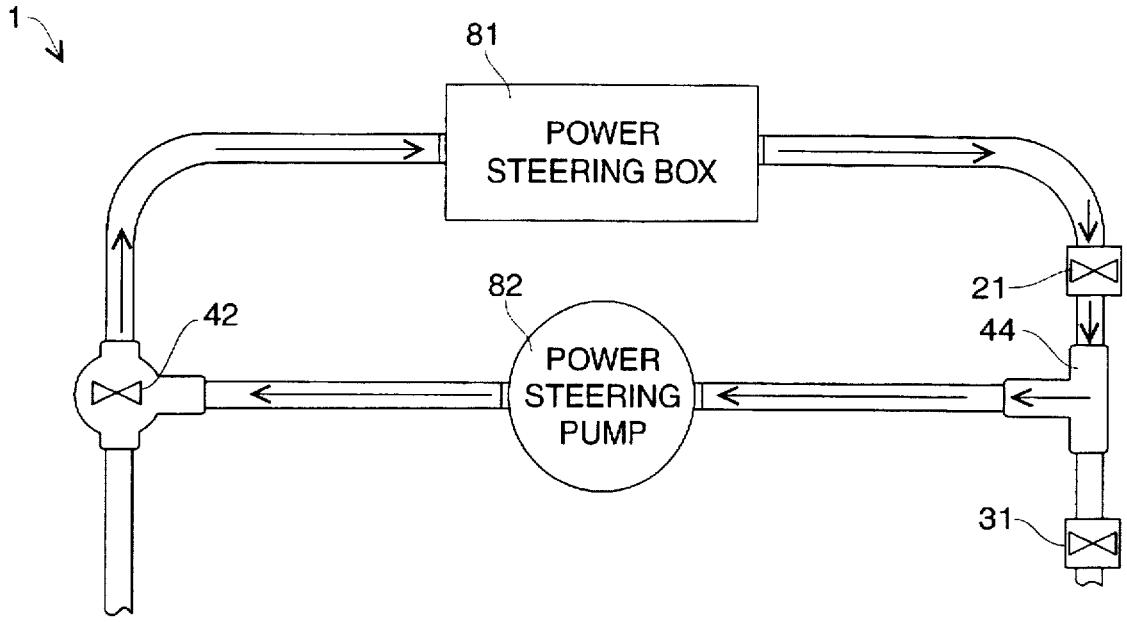
FIG. 2 is a schematic diagram thereof shown in its unused, default state.

FIG. 2 shows how, with the first diverter valve 42 in its default state, the winch is invisible to normal vehicle hydraulic steering operation. On demand, pressurized hydraulic fluid from the power steering pump 82 is directed by the first diverter valve 42 to a power steering box 81. Low pressure hydraulic fluid exiting the power steering box 81 passes through a unidirectional steering check valve 21 to the power steering pump 82 input. The winch check valve 31, located beyond a conventional "T"-shaped connector 44 prevents fluid from escaping the steering system.

Figure 3A:
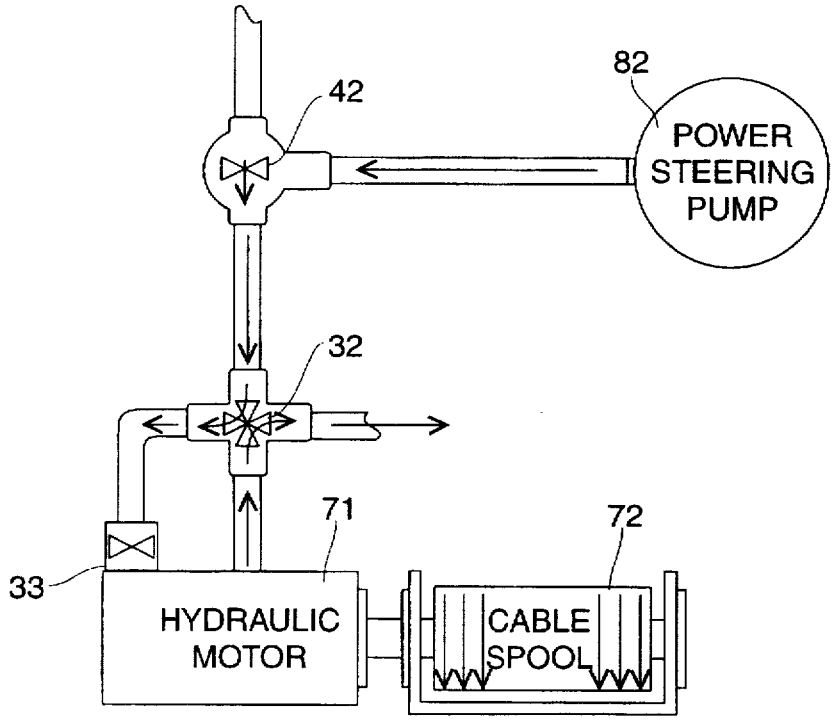
FIG. 3*a* is a schematic diagram thereof shown in an active state with the spool cable moving in a forward position.
Figure 3B:
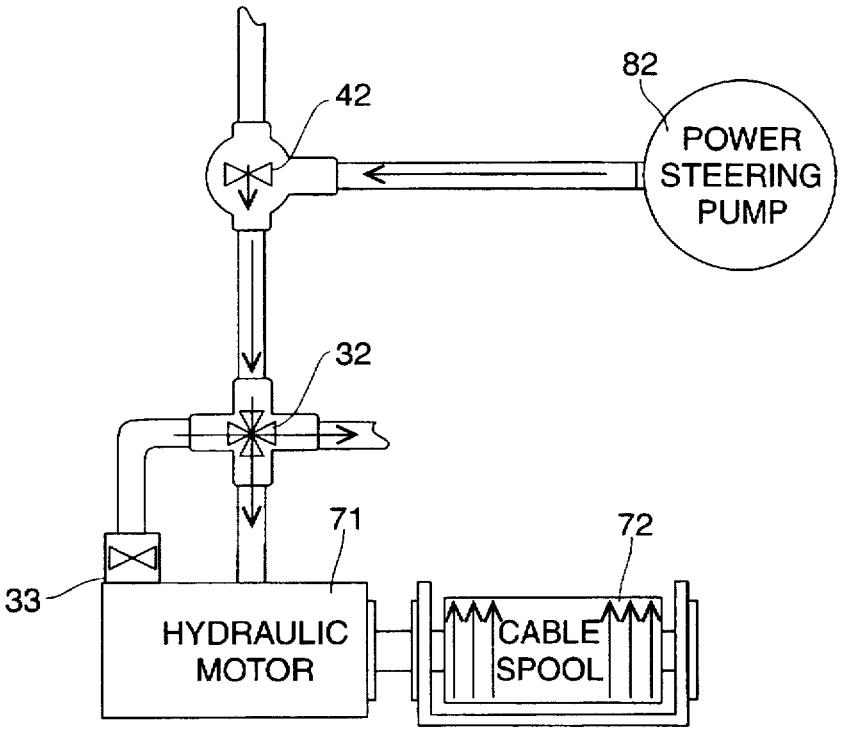
FIG. 3*b* is a schematic diagram thereof shown in an active state with the spool cable moving in a reverse position.
Figure 3C:
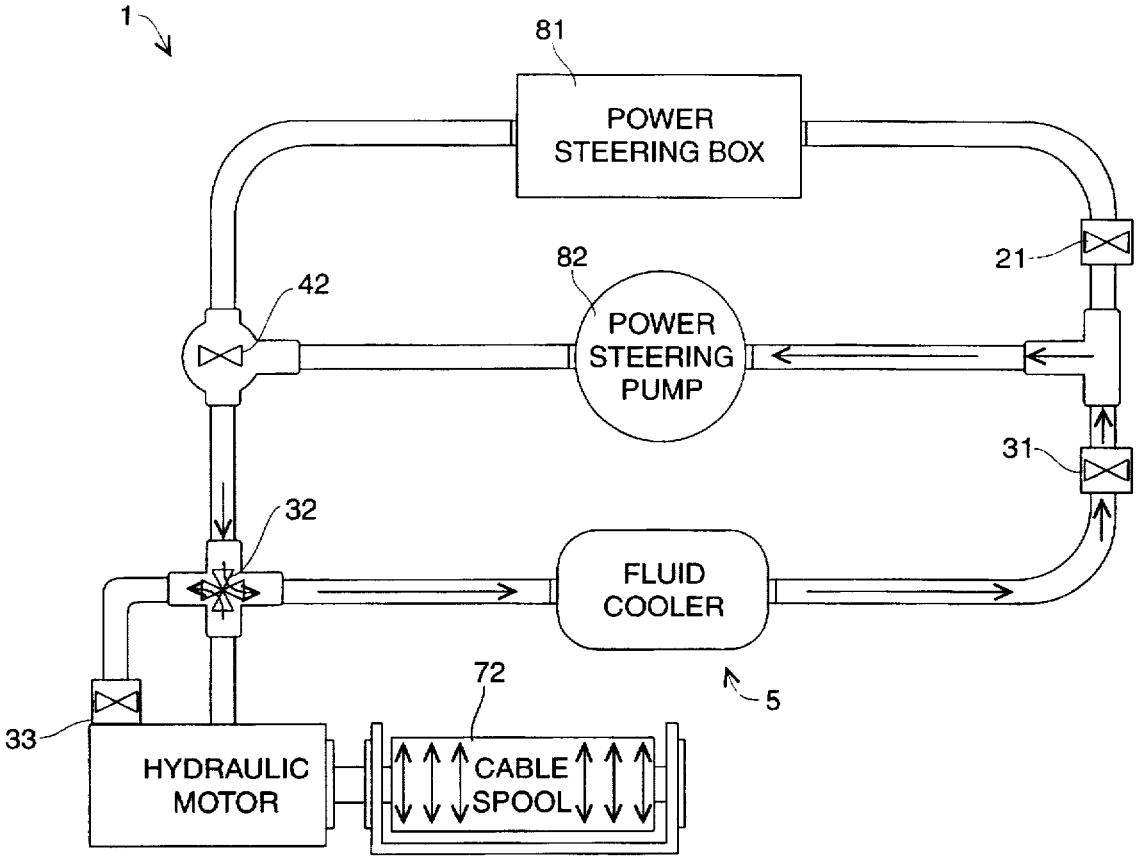
FIG. 3*c* is a schematic diagram thereof shown in an active state with the spool cable in a free-spinning position.

FIGS. 3*a* through 3*c* show how, with the first diverter valve 42 in a switching state, the steering system is invisible to winch operations. Pressurized power steering fluid is pumped through the first diverter valve 42 and is directed toward the first diverter valve 32. The first diverter valve 32 is of the type having four ports inter-switchable amongst each other. As shown in FIG. 3*a* in a first switching state, pressurized hydraulic fluid is directed into an inlet port and thereby drives a hydraulic motor 71 in a forward direction, thereby releasing cable from a cable spool 72 coupled to the hydraulic motor 71. The pressurized fluid which exists from the hydraulic motor is then diverted back out into the fluid flow system toward the fluid cooling means.

As shown in FIG. 3*b*, the first diverter valve 32 is shown in a second state, wherein the pressurized hydraulic fluid is directed into the outlet port of the hydraulic motor 71, and then the hydraulic motor 71 is driven such that cable is rewound onto the cable spool 72. In this state the pressurized fluid exits out from the motor inlet and is directed back into the fluid flow system.

While in a third state as shown in FIG. 3*c*, hydraulic fluid bypasses the hydraulic motor 71 entirely, thereby providing for free spooling of the cable spool 72. While in the free-spooling state, an open biased, electrically switchable shutoff valve 33 affixed to the hydraulic motor 71 input can be switched to block fluid flow and thus provide free spool braking. This electrically switchable shutoff valve 33 can also be affixed to the hydraulic motor 71 output with equal performance.

In all of the three diverter states of the first diverter valve 32, fluid exiting or bypassing the hydraulic motor 71 passes through the fluid cooler 5, and then through the winch check valve 31 to return to the power steering pump 82. The steering check valve 21 prevents fluid from escaping toward the power steering box 81 output.

Figure 4:
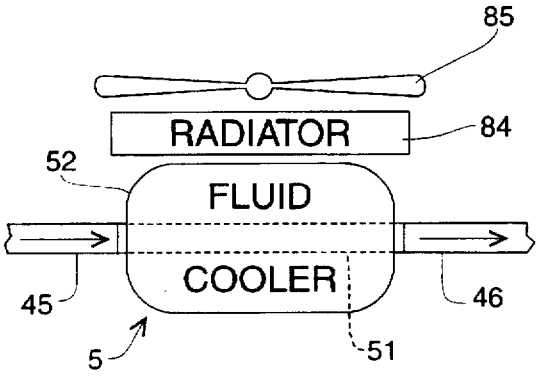
FIG. 4 is a schematic diagram of a fluid cooler for user with the preferred embodiment of the present invention.

FIG. 4 shows how the fluid cooler 5 is a conventional convection cooled section of a tubing 51 with a larger metallic casing 52 to establish a larger, more efficient heat-exchanging surface area. The fluid cooler 5 is affixed in front of a conventional vehicle radiator 84 such that an existing fan 85 provides a draft for improved cooling.

Conventional interconnecting hoses are utilized throughout and connected in a manner consistent with a conventional hydraulic power steering system. Conventional high pressure tubing provides sufficient durability for highly pressurized fluid while low pressure fluid is accommodated by a conventional rubber hose. Conventional hose clamp clamping means are also utilized. Note, however, the lengths and diameters of the tubing and interconnects are exaggerated, for illustrative purposes, to more clearly show operational characteristics.

2. Operation of the Preferred Embodiment

Figure 5:
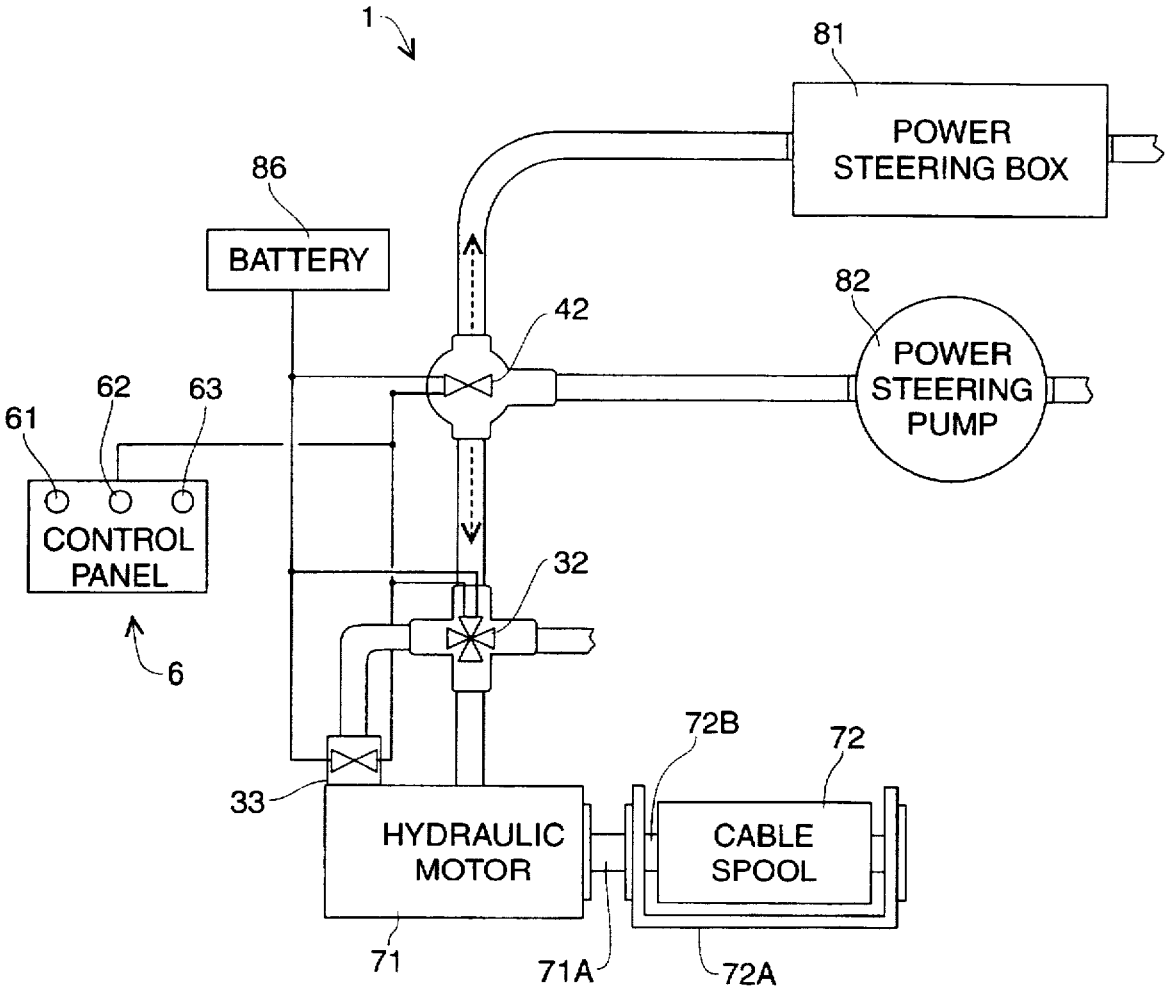
FIG. 5 is an electrical schematic diagram of the control system for use with the preferred embodiment of the present invention.

FIG. 5 shows the electrically controlled switching system for the valves 32, 33 and 42. Momentary switches are envisioned as an economical and simple means of providing safety and protection for the winch user. A winch button 61 must be depressed in order to switch and maintain the first diverter valve 42 in a position such that pressurized hydraulic fluid is re-directed for winch operation. Specific winch functions are further determined by the position of a three state function switch 62 which actuates the first diverter valve 32 into the various states as described above. Further, a momentary brake button 63 similarly opens the first diverter valve 32 to its third "free spooling" state and closes the shutoff valve 33 and for braking purposes. Thus the default path of fluid is that in which fluid is supplied for steering purposes. Accidental winch or free-spool operation is unlikely due to the need to retain the winch button 61 or brake button 63 in a depressed position.

The control panel 6 is releasingly mounted inside the vehicle cabin, thereby removing the operator from the zone danger proximate to the cable spool. However, the control panel 6 can also be removed for specialized applications.

The hydraulic motor 71 is coupled directly to the cable spool mount 72*a*. A keyed shaft 71*a* is then extended into a cable spool hub 72*b*. The outer ends of the hydraulic motor 71 and the cable spool 72 are then supported by bearings affixed to a conventional, heavy-duty winch bumper.

While the above description contains many specificities, these should not be construed as limitations on the scope of the invention, but rather as an example of the preferred embodiment thereof. Many other variations are possible within the spirit and scope of the present invention.

For example, the control panel utilizes electromechanical switching and hard wiring to minimize cost and for simplification. Computer control is anticipated for specialized applications such as weighing, event sequencing, additional safety, single stroke complex switching, etc. Such modification has become somewhat routine with the advent of inexpensive digital-to-analog and digital-to-analog conversion for control and monitoring respectively. Similarly, the control panel is easily made wireless by replacing the wiring with conventional matched transmitter and receiver modules. Both modifications further require either a signal conditioner for connection to the existing vehicle battery, a separate "winch battery", individual power supplies for each powered module or some combination.

Similarly, utilization of a momentary switch protection means is simply seen as the most economical means. Clearly other methods, such as disengagement of the controls while the vehicle is either in gear, while the tires are rotating, until microprocessor based protection feedback means are accommodated, until key combinations are depressed, etc. are anticipated. Other variations of the specific controls or control panel configuration are also anticipated.

Another example is that the fluid direction system and control means are clearly amenable to and provide an improvement to other hydraulic motor, spool and mounting configurations, such as the spool-enclosed motor of Johnson and its progeny. In addition, other known winch improvements, such as disc brakes of Gravenhurst, multiple-spooling as described in Bell, etc. and their progeny are anticipated. Once again, cost and simplicity are key considerations in establishing a preferred, but certainly not a singularly anticipated, embodiment.

Yet another example is that the multi-port valves and other connectors can alternatively be affixed, as is appropriate, directly to the power steering box, power steering pump and hydraulic motor in a conventional manner. The disadvantage of this approach is that installation becomes more difficult for typical retrofit applications. However, new components anticipating winch assembly incorporation will inevitably provide such integration. In addition, cost of such integration will certainly decrease as awareness and demand increase.

Another example is that a gear reduction box could be added between the hydraulic motor and the cable spool. The advantage of this approach would allow for a change of torque with the change in gear ratios.

Again, another example is that an electrically operated remote speed control device could be added to allow for increasing the combustion engine's RPM above the idle range. When needed, this would help increase the output energy without the necessity of entering the driving compartment.

There are, of course, other embodiments also within the spirit and scope of the present invention. The foregoing is included to illustrate the operation of the preferred embodiment and is not meant to limit the scope of the invention. The scope of the invention is to be limited only by the following claims.

What is claimed is:

1. A hydraulic winch assembly for use with a vehicle's steering system comprising:

a. a hydraulic motor;

b. a cable spool;

c. the hydraulic motor configured to drive the cable spool;

d. a first fluid diverting means adapted for hydraulic connection between a discharge of a vehicle steering pump and the hydraulic motor;

e. the first fluid diverting means adapted to divert full fluid flow to a vehicle power steering box when the first fluid diverting means is in a first position, and to divert full fluid flow to the hydraulic motor when the first fluid diverting means is in a second position;

f. a second fluid diverting means adapted for hydraulic connection between the first fluid diverting means and an inlet of the vehicle steering pump;

g. the second fluid diverting means adapted to divert full fluid flow from the first fluid diverting means to an inlet of the hydraulic motor and to divert full fluid flow from an outlet of the hydraulic motor to the inlet of the vehicle steering pump when the second fluid diverting means is in a primary position;

h. the second fluid diverting means adapted to divert full fluid flow from the first fluid diverting means to the outlet of the hydraulic motor and to divert full fluid flow from the inlet of the hydraulic motor to the inlet of the vehicle steering pump when the second fluid diverting means is in a secondary position;

i. the second fluid diverting means adapted to divert full fluid flow from the first fluid diverting means to the inlet of the vehicle steering pump, bypassing the hydraulic motor and permitting fluid flow between the inlet of the hydraulic motor and the outlet of the hydraulic motor through the second fluid diverting means so that manual operation of the winch is permitted, when the second fluid diverting means is in a tertiary position;

j. a shutoff valve adapted for hydraulic connection between the second fluid diverting means and the hydraulic motor to stop fluid flow through the hydraulic motor, thereby providing braking of the hydraulic motor;

k. a first control means for switching the first fluid diverting means between the first position and the second position;

l. a second control means for switching the second fluid diverting means between the primary, the secondary and the tertiary positions; and m. a third control means for closing the shutoff valve and simultaneously switching the second fluid diverting means to the tertiary position to provide braking of the hydraulic motor.

2. The hydraulic winch assembly of claim 1, further comprising a fluid cooler adapted for hydraulic connection between the second fluid diverting means and the inlet of the vehicle steering pump, such that when the first fluid diverting means is in the second position, the fluid cooler and the vehicle steering pump both receive full fluid flow.

3. The hydraulic winch assembly of claim 2, wherein the fluid cooler is adapted to be positioned adjacent a vehicle radiator and is further adapted to cool fluid by convection through draft provided by a vehicle radiator fan.

4. A hydraulic winch assembly in combination with a vehicle steering system comprising:

a. a hydraulic motor;

b. a cable spool;

c. a vehicle steering pump;

d. a vehicle power steering box;

e. the hydraulic motor configured to drive the cable spool;

f. a first fluid diverting means hydraulically connected between a discharge of the vehicle steering pump and the hydraulic motor;

g. the first fluid diverting means configured to divert full fluid flow to the vehicle power steering box when the first fluid diverting means is in a first position, and to divert full fluid flow to the hydraulic motor when the first fluid diverting means is in a second position;

h. a second fluid diverting means hydraulically connected between the first fluid diverting means and an inlet of the vehicle steering pump;

i. the second fluid diverting means configured to divert full fluid flow from the first fluid diverting means to an inlet of the hydraulic motor and to divert full fluid flow from an outlet of the hydraulic motor to the inlet of the vehicle steering pump when the second fluid diverting means is in a primary position;

j. the second fluid diverting means configured to divert full fluid flow from the first fluid diverting means to the outlet of the hydraulic motor and to divert full fluid flow from the inlet of the hydraulic motor to the inlet of the vehicle steering pump when the second fluid diverting means is in a secondary position;

k. the second fluid diverting means configured to divert full fluid flow from the first fluid diverting means to the inlet of the vehicle steering pump, bypassing the hydraulic motor and permitting fluid flow between the inlet of the hydraulic motor and the outlet of the hydraulic motor through the second fluid diverting means so that manual operation of the winch is permitted, when the second fluid diverting means is in a tertiary position;

l. a shutoff valve hydraulically connected between the second fluid diverting means and the hydraulic motor to stop fluid flow through the hydraulic motor, thereby providing braking of the hydraulic motor;

m. a first control means for switching the first fluid diverting means between the first position and the second position;

n. a second control means for switching the second fluid diverting means between the primary, the secondary and the tertiary positions; and o. a third control means for closing the shutoff valve and simultaneously switching the second fluid diverting means to the tertiary position to provide braking of the hydraulic motor.

5. The hydraulic winch assembly of claim 4, further comprising a fluid cooler hydraulically connected between the second fluid diverting means and the inlet of the vehicle steering pump, such that when the first fluid diverting means is in the second position, the fluid cooler and the vehicle steering pump both receive full fluid flow.

6. The hydraulic winch assembly of claim 5, wherein the fluid cooler is positioned adjacent a vehicle radiator and is configured to cool fluid by convection through draft provided by a vehicle radiator fan.

7. A hydraulic winch assembly for use with a vehicle's steering system comprising:

a. a hydraulic motor;

b. a cable spool;

c. the hydraulic motor configured to drive the cable spool;

d. a fluid diverting means adapted to selectively divert full fluid flow from a discharge of a vehicle steering pump to a vehicle power steering box, to an inlet of the hydraulic motor, and to an outlet of the hydraulic motor; and e. the fluid diverting means further adapted to bypass fluid flow from the discharge of the vehicle steering pump around the hydraulic motor and to permit fluid flow between the inlet of the hydraulic motor and the outlet of the hydraulic motor through the fluid diverting means so that manual operation of the winch is permitted.

* * * * *